US010330344B2

(12) United States Patent
Teng et al.

(10) Patent No.: US 10,330,344 B2
(45) Date of Patent: Jun. 25, 2019

(54) TEMPERATURE ALGORITHM FOR WATER HEATER

(71) Applicant: A. O. SMITH CORPORATION, Milwaukee, WI (US)

(72) Inventors: Yingwu Teng, Charlotte, NC (US); Michael William Schultz, Columbia, SC (US); Carl Edward McDow, Albemarle, NC (US)

(73) Assignee: A. O. SMITH CORPORATION, Milwaukee, WI (US)

( * ) Notice: Subject to any disclaimer, the term of this patent is extended or adjusted under 35 U.S.C. 154(b) by 31 days.

(21) Appl. No.: 15/656,878

(22) Filed: Jul. 21, 2017

(65) Prior Publication Data

US 2019/0024944 A1 Jan. 24, 2019

(51) Int. Cl.
*F24H 9/20* (2006.01)
*F24H 9/12* (2006.01)

(52) U.S. Cl.
CPC ..... *F24H 9/2007* (2013.01); *F24H 9/124* (2013.01)

(58) Field of Classification Search
CPC ..... F24H 9/2007; F24H 9/124
See application file for complete search history.

(56) References Cited

U.S. PATENT DOCUMENTS 4,257,397 A * 3/1981 Gouyou-Beauchamps ..... F24D 17/0068 126/587
4,363,221 A * 12/1982 Singh ..... F24D 17/02 62/238.6
4,543,468 A * 9/1985 Shaffer, Jr. ..... F24D 19/1054 122/14.22
2009/0234513 A1* 9/2009 Wiggins ..... F24D 19/1051 700/300
2013/0193221 A1* 8/2013 Buescher ..... F24H 9/2021 237/8 A
2017/0003052 A1* 1/2017 Watts ..... F24H 9/2007
2017/0356660 A1* 12/2017 Branecky ..... F24D 17/0026

FOREIGN PATENT DOCUMENTS

JP 61153341 A * 7/1986 ..... G05D 23/1917

* cited by examiner

*Primary Examiner* — Nathaniel Herzfeld
(74) *Attorney, Agent, or Firm* — Michael Best & Friedrich LLP

(57) ABSTRACT

A water heater including a storage tank including a water inlet and a water outlet, a pump, an upper temperature sensor, a lower temperature sensor, and an electronic processor. The electronic processor is configured to receive an upper temperature signal and a lower temperature signal, compare the upper temperature signal to a sum of a setpoint temperature threshold minus a temperature differential, and compare the lower temperature signal to a high limit temperature threshold. The electronic processor is further configured to activate the pump in response to the first upper temperature signal being less than the sum of the setpoint temperature threshold minus the temperature differential and the first lower temperature signal being less than the predetermined high limit temperature threshold.

20 Claims, 5 Drawing Sheets

TEMPERATURE ALGORITHM FOR WATER HEATER

FIELD OF APPLICATION

Embodiments relate to water heaters.

SUMMARY

Water heating systems may include a hot water storage tank, an external heater, a circulation pump, and a tank thermostat. Some external heaters include tank thermostats that are set below the setpoint of the external heater by a set number (for example, 10° F.). This method may not provide optimal tank temperature regulation. For example, when there is a hot water draw, depending on the location of the tank thermostat, the circulation pump may be activated quickly even if the majority of the storage tank is full of hot water. When the amount of hot water discharge is small, the external heater would rapidly turn off. This may result in short cycling both the pump and the external heater. In addition, depending on the setpoint of the external heater, hot water may enter the inlet of the external water heater, reducing energy efficiency.

Therefore, in one embodiment, the application provides a water heater including a storage tank including a water inlet and a water outlet, a pump, an upper temperature sensor configured to sense an upper temperature related to an upper area of the tank and output an upper temperature signal corresponding to the upper temperature, a lower temperature sensor configured to sense a lower temperature related to a lower area of the tank and output a lower temperature signal corresponding to the lower temperature, and an electronic processor. The electronic processor is configured to receive an upper temperature signal and a lower temperature signal, compare the upper temperature signal to a sum of a setpoint temperature threshold minus a temperature differential, and compare the lower temperature signal to a high limit temperature threshold. The electronic processor is further configured to activate the pump in response to the first upper temperature signal being less than the sum of the setpoint temperature threshold minus the temperature differential and the first lower temperature signal being less than the predetermined high limit temperature threshold.

In another embodiment, the application provides a method of operating a water heater including a storage tank including a water inlet and a water outlet, a pump, an upper temperature sensor configured to sense an upper temperature related to an upper area of the tank and output an upper temperature signal corresponding to the upper temperature, and a lower temperature sensor configured to sense a lower temperature related to a lower area of the tank and output a lower temperature signal corresponding to the lower temperature. The method includes receiving a first upper temperature signal and a first lower temperature signal, comparing the first upper temperature signal to a sum of a setpoint temperature threshold minus a temperature differential, comparing the first lower temperature signal to a high limit temperature threshold, and activating the pump in response to the first upper temperature signal being less than the sum of the setpoint temperature threshold minus the temperature differential and the first lower temperature signal being less than the predetermined high limit temperature threshold.

Other aspects of the application will become apparent by consideration of the detailed description and accompanying drawings.

DETAILED DESCRIPTION

Before any embodiments of the application are explained in detail, it is to be understood that the application is not limited in its application to the details of construction and the arrangement of components set forth in the following description or illustrated in the following drawing. The application is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Figure 1:
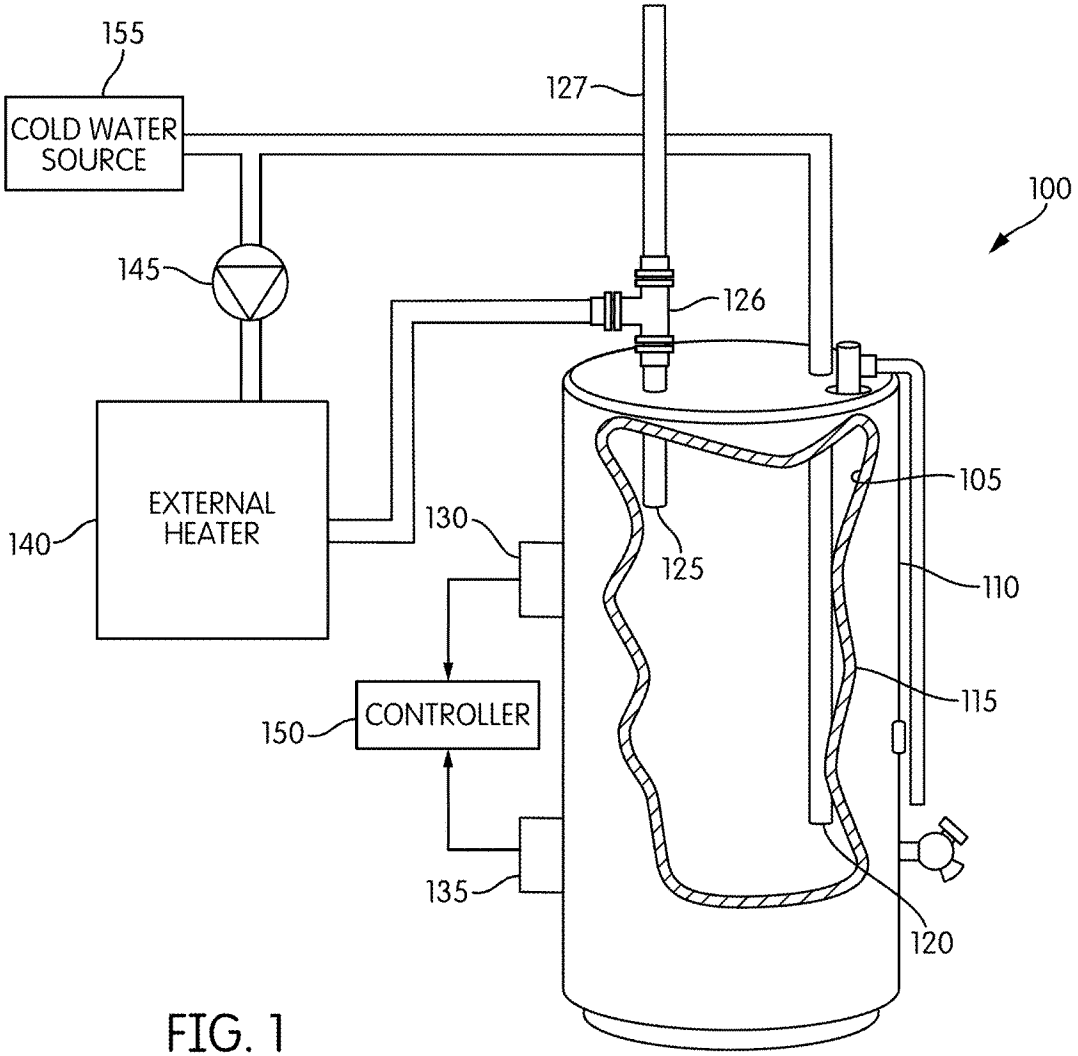
FIG. 1 is a partial exposed view of a water heater according to some embodiments of the application.

FIG. 1 is a partial exposed view of a storage-type water heater system 100 according to some embodiments of the application. In some embodiments, the water heater system 100 is a hybrid tank and tankless water heater system. The water heater system 100 includes an enclosed water tank 105, a shell 110 surrounding the water tank 105, and foam insulation 115 filling an annular space between the water tank 105 and the shell 110. The water tank 105 may be made of ferrous metal and lined internally with a glass-like porcelain enamel or other materials to protect the metal from corrosion. In other embodiments, the water tank 105 may be made of other materials, such as plastic or stainless steel.

The water heater system 100 may further include a cold water inlet opening 120, a hot water inlet opening 125, a water t-valve 126, a hot water outlet 127, an upper temperature sensor 130, a lower temperature sensor 135, an external heater 140, a circulation pump (or valve) 145, and a controller 150. A cold water source 155 provides cold water to the water tank 105 through the cold water inlet opening 120. The cold water source 155 also delivers cold water to the external heater 140 through the circulation pump 145. The circulation pump 145 may be controlled by the controller 150. When the circulation pump 145 is active, the external heater 140 receives the cold water and heats the cold water to a predetermined temperature. From the external heater 140, the water is then delivered to the water t-valve 126, which directs the water to the water tank 105, via hot water inlet opening 125, or to a user, via hot water outlet 127.

The upper temperature sensor 130 may be positioned in the upper portion of the water tank 105 to determine a temperature of the water stored in the upper portion of the water tank 105. Analogously, the lower temperature sensor 135 may be positioned in the lower portion of the water tank 105 to determine a temperature of the water in the lower portion of the water tank 105. The upper temperature sensor 130 and the lower temperature sensor 135 may be attached to the water tank 105, and may include, for example, thermistor type sensors. The upper temperature sensor 130 and the lower temperature sensor 135 may be electrically and/or communicatively coupled to the controller 150 to periodically provide the sensed temperatures to the controller 150. In some embodiments, the water tank 105 may include more temperature sensors to provide a more accurate indication of the temperature of water inside the water tank 105. For example, the water tank 105 may be divided into three or more portions and a temperature sensor may be positioned in each portion. The distance between the upper temperature sensor 130 and the lower temperature sensor 135 may be determined based on the geometry of the tank, a desired tank recovery, and the water stratification pattern inside the water tank 105. In some embodiments, the shorter the distance between sensors 130 and 135, the sooner the external heater 140 and circulation pump 145 may activate (when implementing a control method 300 described in FIG. 3 or a control method 500 described in FIG. 5).

The controller 150 is electrically and/or communicatively coupled to the upper temperature sensor 130, the lower temperature sensor 135, and the circulation pump 145. In some embodiments, the controller 150 is also electrically and/or communicatively coupled to the external heater 140. The controller 150 receives the temperature signals from the upper temperature sensor 130 and the lower temperature sensor 135. Based on the received temperature signals, the controller 150 may control the operation of the external heater 140 and/or the circulation pump 145 as described in detail below.

Figure 2:
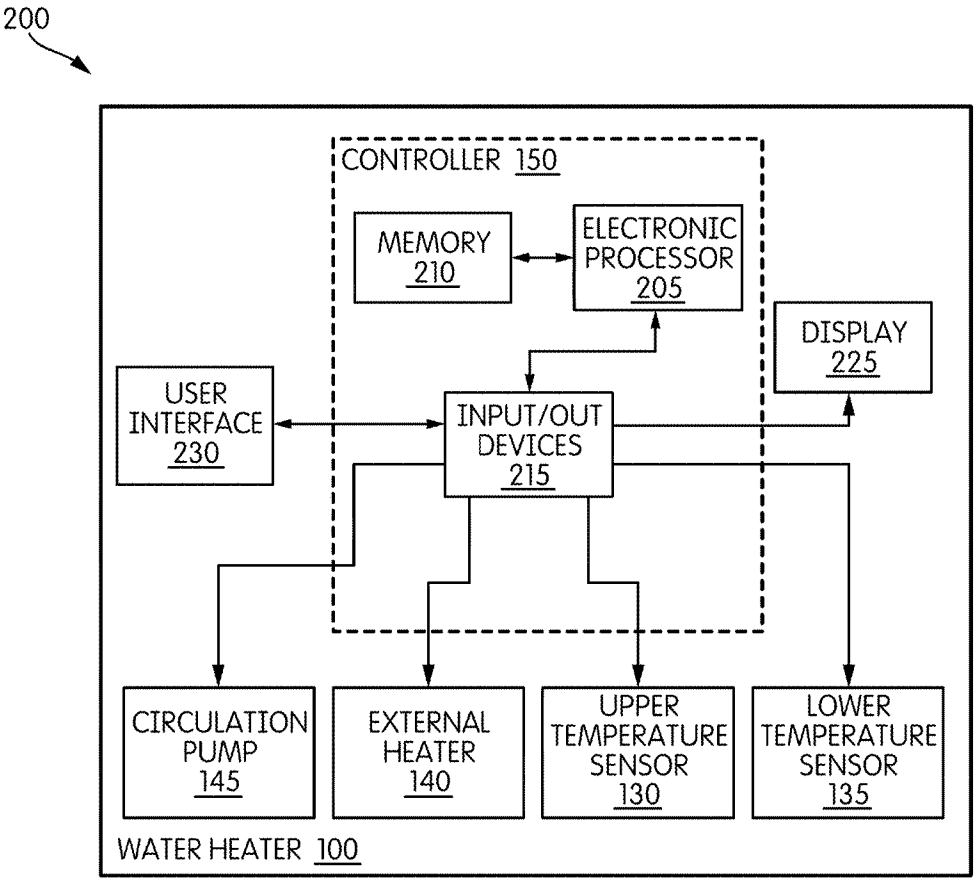
FIG. 2 is a schematic diagram of a control system of the water heater of FIG. 1 according to some embodiments of the application.

FIG. 2 is schematic diagram of a control system 200 of the water heater of FIG. 1 according to some embodiments of the application. The control system 200 includes the controller 150, the upper temperature sensor 130, the lower temperature sensor 135, the external heater 140, and the circulation pump 145. In some embodiments, the control system 200, or at least part of the control system 200 may be located remotely from the water heater system 100. The control system 200 includes combinations of hardware and software that are operable to, among other things, control the operation of the water heater system 100. As shown in FIG. 2, the controller 150 includes an electronic processor 205, a memory 210, and input/output devices 215. In some embodiments, the controller 150 also includes a communication module to transmit and receive information via wired or wireless communication with one or more external devices. In further embodiments, the controller 150 also includes a display 225 and a user interface 230.

The electronic processor 205 is communicatively coupled to the memory 210 and to the input/output device 215. The electronic processor 205 receives information regarding the operation of the water heater system 100 through the input/output devices 215. The electronic processor 205 may receive command signals received from the user interface 230 or a network and determine control signals based on the command signals received. The electronic processor 205 may then output the control signals to the input/output devices 215.

The memory 210 is configured to store algorithms and/or programs used to control the circulation pump 145, the external heater 140, and other components of the water heater system 100. The memory 210 may also store historical data, usage patterns, and the like to help control the water heater system 100. The memory 210 also stores the control method 300 described in FIG. 3 and the control method 500 described in FIG. 5 executed by the electronic processor 205 to operate the circulation pump 145 based on the measurements The input/output devices 215 output information to the user regarding the operation of the water heater system 100 and may also receive inputs. The controller 150 communicates (via wireless or wired connection) with the upper temperature sensor 130, the lower temperature sensor 135, the external heater 140, and the circulation pump 145 via the input/output devices 215. In some embodiments, the input/output devices 215 may include the user interface 230 for the water heater system 100. The input/output devices 215 may include a combination of digital and analog input or output devices required to achieve level of control and monitoring for the water heater system 100. For example, the input/output devices 215 may include a touch screen, a speaker, buttons, and the like to receive user input regarding the operation of the water heater system 100 (for example, a temperature set point at which water is to be delivered from the water tank 105). The electronic processor 205 also outputs information to the user in the form of, for example, graphics, alarm sounds, and/or other known output devices. The input/output devices 215 may be used to control and/or monitor the water heater system 100. For example, the input/output devices 215 may be operably coupled to the controller 150 to control temperature settings of the water heater system 100. For example, using the input/output devices 215, a user may set one or more temperature set points for the water heater system 100.

The input/output devices 215 are configured to display conditions, or data, associated with the water heater system 100 in real-time or substantially real-time. For example, but not limited to, the input/output devices 215 may be configured to display the temperature sensed by temperature sensors 130, 135. The input/output devices 215 may be mounted on the shell 110 of the water heater system 100, remotely from the water heater system 100 in the same room (e.g., on a wall), in another room in the building, or even outside of the building. In some embodiments, the input/output devices 215 may also generate alarms regarding the operation of the water heater system 100. The input/output devices 215 allow the controller 150 to communicate with the upper temperature sensor 130, the lower temperature sensor 135, the circulation pump 145 and the external heater 140.

Figure 3:
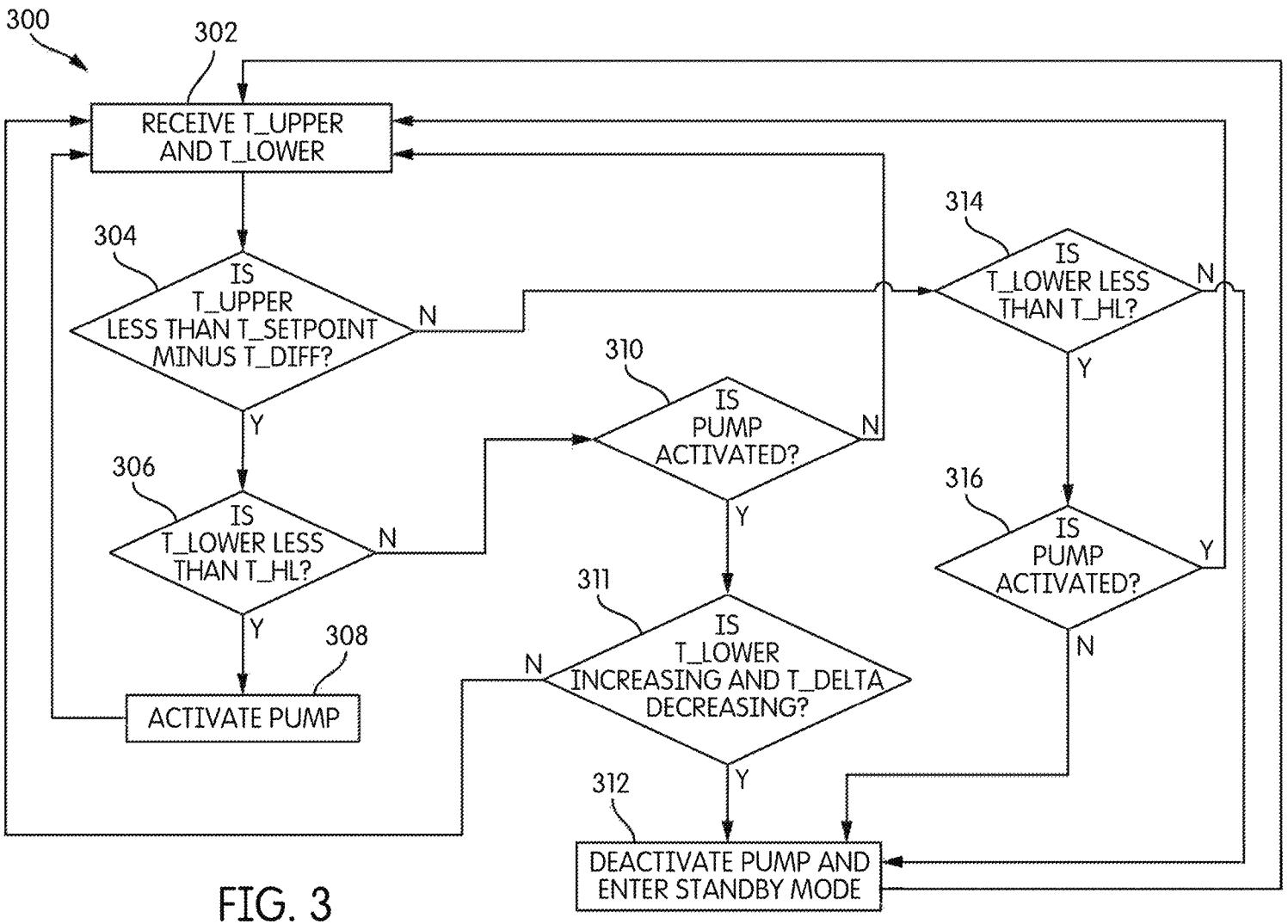
FIG. 3 is a flowchart illustrating a method of operating the water heater of FIG. 1 according to some embodiments of the application.

FIG. 3 is a flowchart illustrating a method 300 of operating the water heater system 100 according to some embodiments of the application. At block 302, the controller 150 receives an upper temperature signal (T__upper) from the upper temperature sensor 130 and a lower temperature signal (T_lower) from the lower temperature sensor 135. At block 304, T_upper is compared to the sum of a setpoint temperature threshold (T_setpoint) minus a temperature differential (T_diff). When T_upper exceeds (is greater than) or equal to T_setpoint-T_diff, block 302 is repeated. When T_upper is less than T_setpoint-T_diff, T_lower is compared to a high limit threshold (T_HL) at block 306. When T_lower is less than T_HL, the circulation pump 145 (and the external heater 140) are activated at block 308. When T_lower is greater than or equal to T_HL and the circulation pump 145 is not activated (block 310), the method 300 starts again at block 302.

In some embodiments, T_setpoint is a measured temperature from a sensor, for example the upper sensor 130, received by the controller 150. In some embodiments, where the controller 150 is communicatively coupled to the external heater 140, T_setpoint may be a set desired temperature of water at the outlet of the external heater 140 selected by an operator of the water heater system 100 (for example, via the user interface 230).

After the circulation pump 145 is activated at block 308, hot water is supplied to the water tank 105 and the method 300 returns to block 302. When the system starts from a cold tank, T_upper is less than T_setpoint-T_diff. As the external heater 140 continues to run and the circulation pump 145 supplies hot water to the water tank 105, the hot water within the water tank 105 rises to the upper portion of the tank. The water within the lower portion of the water tank 105 will remain at a constant, lower temperature as a result of the hot water entering the water tank 105 stratifying to the top of the water tank. The hot water stratification continues until the temperature of water in the upper portion of the water tank 105 reaches an approximately constant temperature. At this point, the water in the lower portion of the water tank 105 will increase in temperature, causing T_lower to increase.

Once it is determined that T_lower is greater than or equal to T_HL (block 306), and it is determined that the pump is active (block 310), a determination is made whether a rate of temperature of T_lower is increasing and a difference between T_upper and T_lower ( T_delta) is decreasing (block 311). At block 311, the controller 150 may determine if T_lower is increasing and if T_delta is decreasing by collecting multiple readings of T_upper and T_lower for a predetermined time from the upper temperature sensor 130 and the lower temperature sensor 135 respectively. When the controller 150 determines T_lower is increasing and T_delta is decreasing, the circulation pump 145 and external heater 140 are deactivated and the water heater 100 is placed into a standby mode (block 312). When the controller 150 determines T_lower is not increasing and/or T_delta is not decreasing, the controller 150 returns to block 302. When the controller 150 determines that the circulation pump 145 is not active (block 310), the controller 150 returns to block 302. At block 312, when the water heater 100 is placed into the standby mode, the controller 150 returns to block 302.

In some embodiments, the controller 150 is not communicatively coupled to the external heater 140. In such embodiments, when the desired outlet temperature is set at the external heater 140, the desired outlet temperature of the external heater 140 may be adjusted to a temperature greater than the current T_setpoint, stored by the controller 150, minus T_diff (block 304). A hot water draw may reduce T_lower to be less than T_HL while T_upper remains the same, which may lead to short cycling of the water heater. To prevent short cycling, the controller 150 determines if T_lower is less than T_HL (block 314). When the controller 150 determines that T_lower is less than T_HL, the controller further determines if the circulation pump 145 is activated (block 316). When the controller 150 determines the circulation pump 145 is activated, it returns to block 302; when the controller 150 determines that the circulation pump 145 is not activated, the controller 150 continues to keep the circulation pump 145 deactivated and the water heater 100 remains in the standby mode (block 312). When the controller 150 determines that T_lower is greater than or equal to T_HL (block 314), the controller 150 returns to block 312 and then block 302.

While the water heater system 100 is in the standby mode, the controller 150 updates T_setpoint and T_HL. In some embodiments, T_setpoint is updated based on a maximum temperature sensed by the upper temperature sensor 130 while in the standby mode. In some embodiments, T_setpoint is set by an operator of the water heater system 100 (for example, via the user interface 230) and is associated with the outlet temperature of the external heater 140. In some embodiments, T_HL is a predetermined default value automatically set based on a set temperature of the external heater 140. In further embodiments, the operator of the water heater system 100 is able to configure T_HL to be higher (or lower) than the predetermined default value.

Figure 4:
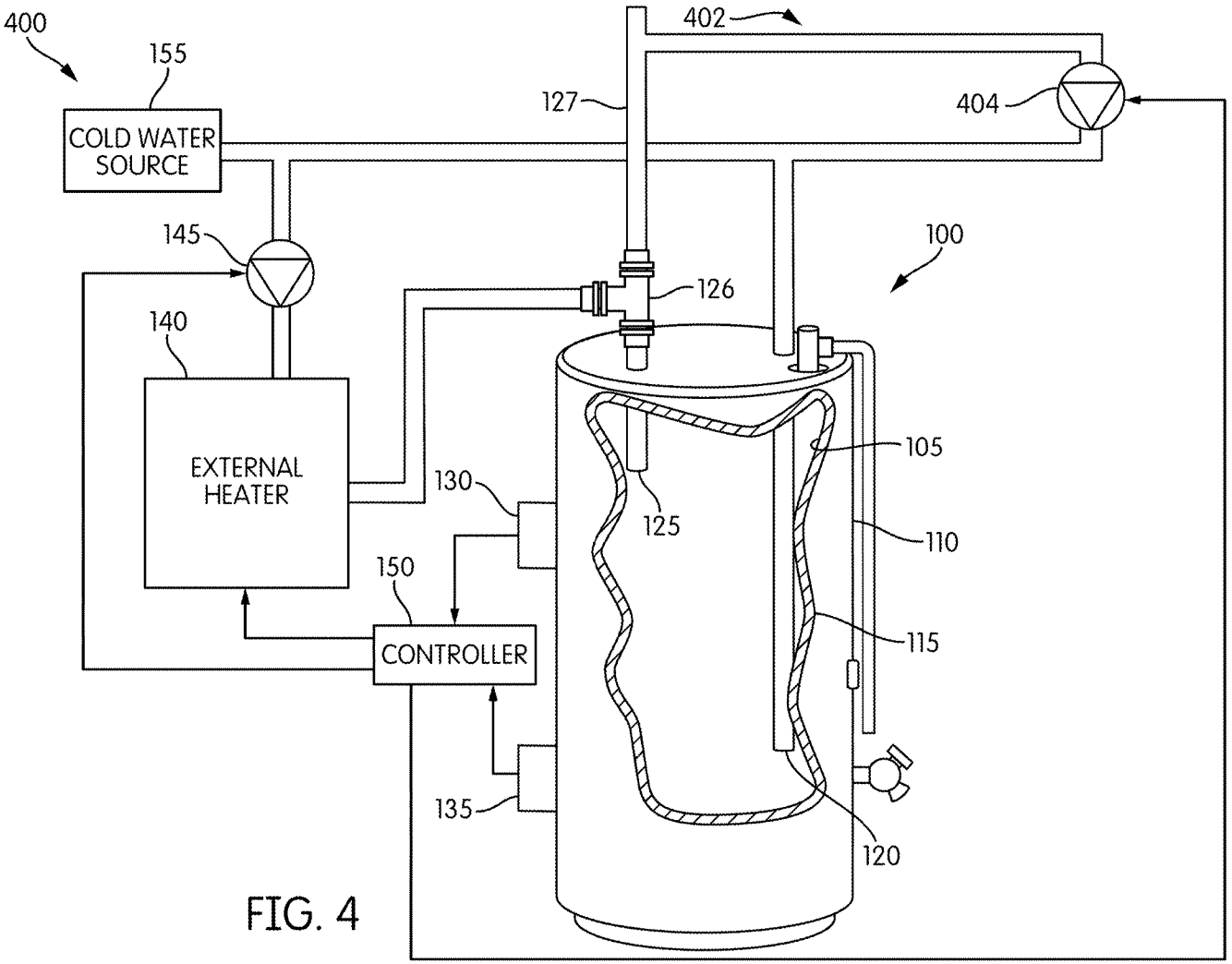
FIG. 4 is a partial exposed view of a water heater with a recirculation loop according to some embodiments of the application.

The method 300 may be applied to other types, configurations, geometries, and sizes of water heaters beyond what is illustrated. Such embodiments may include more than one tank, external heater, sensors, pumps, and the like. Depending on such characteristics of the water heater, additional steps may be added to the method 300. For example, FIG. 4 is a partial exposed view of a water heater 400 with a recirculation loop 402 according to some embodiments of the application. The water heater 400 includes similar components and is configured similarly to the water heater system 100 illustrated in FIG.1 described above. However, the embodiment illustrated in FIG. 4 includes additional components, such as the recirculation loop 402 and a recirculation pump 404. The recirculation loop 402 is configured to return hot water to the cold water inlet 120 through the recirculation pump 404. The recirculation pump 404 may be communicatively coupled to and controlled by the controller 150. In the embodiment illustrated in FIG. 4, the control method 300 may still be implemented. However, due to the draw of the recirculation loop 402, additional blocks to the control method 300 may be necessary.

Figure 5:
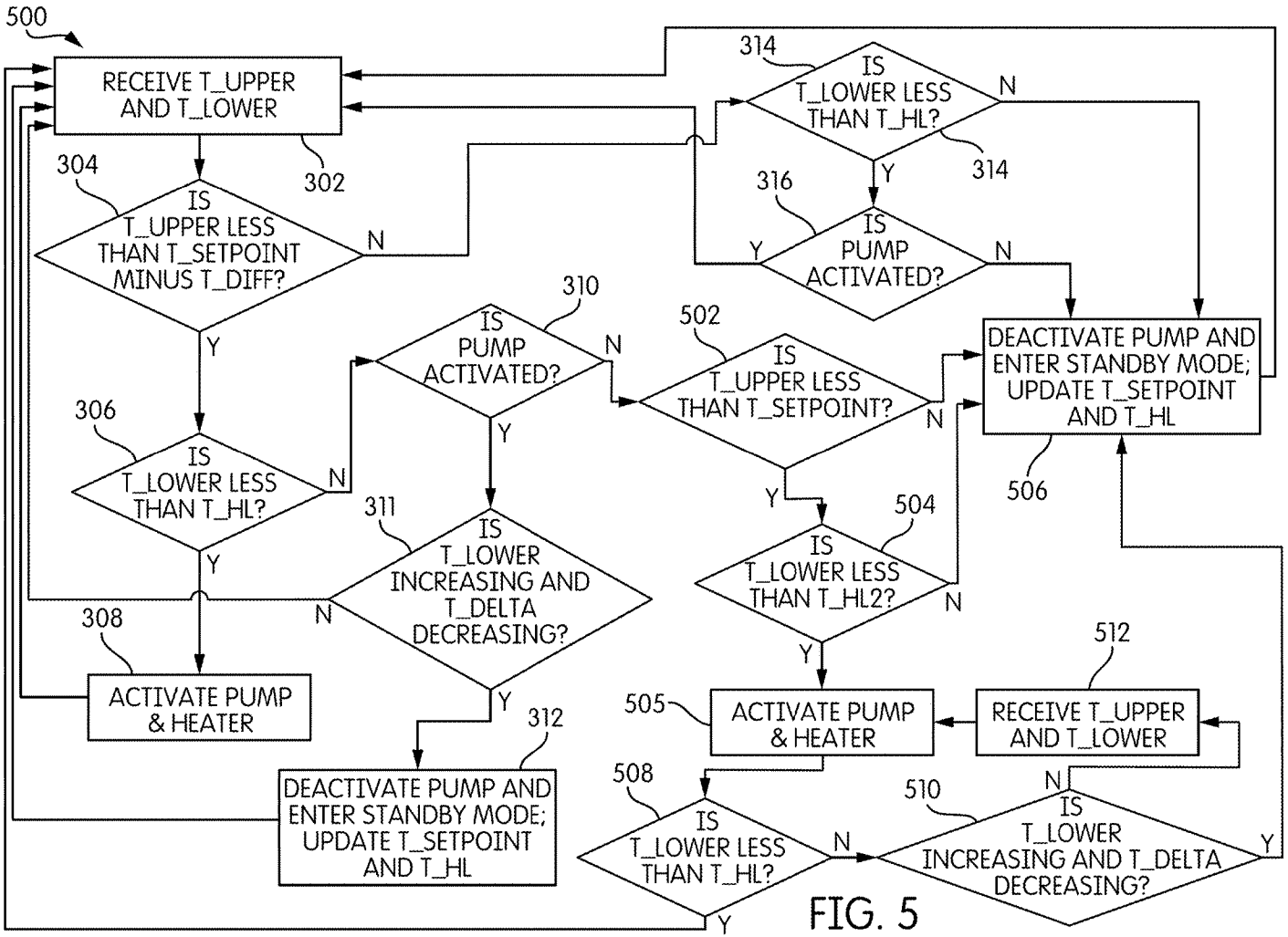
FIG. 5 is a flowchart illustrating a method of operating the water heater of FIG. 4 according to some embodiments of the application.

FIG. 5 illustrates the control method 500 for the water heater 400. The control method 500 includes the similar components of the method 300 of FIG. 3 with some additions. In the illustrated embodiment, when the pump is not activated and when T_upper is less than the sum of T_setpoint-T_diff (block 304), T_lower may be greater than T_HL. Such a situation may occur when there is no hot water draw other than from the recirculation loop 402. To compensate for the loss due to the recirculation loop 402, as described in more detail below, the circulation pump 145 and the external heater 140 are activated (block 505) when it is determined that T_lower is greater than or equal to T_HL (at block 306) and that the circulation pump 145 is not activated (at block 310), and that T_upper is less than T_setpoint and T_lower is less than a second high limit temperature threshold T_HL2 (block 504).

When it is determined at block 310 that the circulation pump 145 is not activated, T_upper is compared to T_setpoint (block 502). When T_upper is greater than or equal to T_setpoint (block 502), the circulation pump 145 and the external heater 140 are deactivated and the water heater 400 is placed into the standby mode (block 506) and the controller 150 returns to block 302. When T_upper is less than T_setpoint (block 502), T_lower is compared to a second high limit temperature threshold T_HL2 at block 504. When T_lower is greater than T_HL2 (block 504), the circulation pump 145 and external heater 140 are deactivated and the water heater 400 is placed into the standby mode (block 506).

When T_lower is less than T_HL2 and circulation pump 145 is activated, T_lower is compared to T_HL at block 508. When T_lower is less than T_HL (block 508), the controller 150 returns to block 302. When T_lower is greater than or equal to T_HL (block 508), the controller 150 may determine if T_lower is increasing and if T_delta is decreasing (block 510).

At block 510, the controller 150 may determine if T_lower is increasing and if T_delta is decreasing by collecting multiple readings of T_upper and T_lower for a predetermined time from the upper temperature sensor 130 and the lower temperature sensor 135 respectively. When the controller 150 determines T_lower is increasing and T_delta is decreasing (block 510), the circulation pump 145 and external heater 140 are deactivated and the water heater 400 is placed into the standby mode (block 506). When the controller 150 determines T_lower is not increasing and/or T_delta is not decreasing (block 510), the controller 150 receives another T_upper from the upper temperature sensor 130 and another T_lower from the lower temperature sensor 135 (block 512) and returns to block 505.

Within the control method 500, when there is an external hot water draw (a hot water draw not by the recirculation loop 402) that causes T_lower to be less than T_HL, the controller 150 may execute only the blocks within the control method 500 that are in control method 300 (blocks 302, 304, 306, 308, 310, 311, and 312).

The controller 150 may include additional features to aid in the efficiency of the water heater system 100. In some embodiments, the controller 150 is further configured to drive a modulation pump. For example, when the upper temperature sensor 130 senses the temperature in the upper area of the tank approaching T_setpoint, the controller 150 modulates down the pump so to reduce the flow rate running through the external heater 140.

Various features and advantages of the application are set forth in the following claims.

What is claimed is:

1. A water heater comprising:

a storage tank including a water inlet and a water outlet;

a circulation pump configured to deliver water to an external heater of the water heater;

an upper temperature sensor configured to sense an upper temperature related to an upper area of the tank and output an upper temperature signal corresponding to the upper temperature;

a lower temperature sensor configured to sense a lower temperature related to a lower area of the tank and output a lower temperature signal corresponding to the lower temperature; and an electronic processor configured to:

receive a first upper temperature signal and a first lower temperature signal;

compare the first upper temperature signal to a sum of a setpoint temperature threshold minus a preset temperature differential value;

compare the first lower temperature signal to a high limit temperature threshold; and activate the circulation pump in response to the first upper temperature signal being less than the sum of the setpoint temperature threshold minus the temperature differential value and the first lower temperature signal being less than the predetermined high limit temperature threshold.

2. The water heater of claim 1, wherein the electronic processor is further configured to:

while the circulation pump is activated, compare a second lower temperature signal to the predetermined high limit temperature threshold; and in response to the second lower temperature signal being equal to or exceeding the predetermined high limit temperature threshold, deactivate the circulation pump.

3. The water heater of claim 2, wherein the electronic processor is further configured to in response to the second lower temperature signal exceeding the predetermined high limit temperature threshold, place the water heater in a standby mode;

wherein, while in the standby mode, at least one selected from the group consisting of the predetermined setpoint temperature threshold and the predetermined high limit temperature threshold is updated.

4. The water heater of claim 3, wherein the predetermined setpoint temperature threshold is updated based on a maximum temperature sensed by the upper temperature sensor while the storage tank is in the standby mode.

5. The water heater of claim 3, wherein the electronic processor is further configured to while the circulation pump is activated, determine at least one selected from the group consisting of a rate of temperature based on a third lower water temperature signal and a difference between a second upper water temperature signal and the third lower water temperature signal; and deactivate the circulation pump in response to at least one selected from the group consisting of the rate of temperature increasing and the difference decreasing.

6. The water heater of claim 5, wherein the electronic processor is further configured to:

activate the circulation pump in response to the first upper temperature signal being less than the sum of the predetermined setpoint temperature threshold minus the temperature differential value, the first lower temperature signal being less than the predetermined high limit temperature threshold, a third upper temperature signal being less than the predetermined setpoint temperature threshold and a fourth lower temperature signal being less than a second predetermined high limit threshold; and in response to at least one selected from the group consisting of the third upper temperature signal being greater than or equal to the predetermined setpoint temperature threshold and the fourth lower temperature signal being equal or greater than the second predetermined high limit temperature threshold, deactivate the circulation pump.

7. The water heater of claim 6 wherein the electronic processor is further configured to:

in response to at least one selected from the group consisting of the third upper temperature signal being less than the predetermined setpoint temperature threshold and the fourth lower temperature signal being less than the second predetermined high limit temperature threshold, determine at least one selected from the group consisting of a second rate of temperature based on a fifth lower water temperature signal and a second difference between a fourth upper water temperature signal and the fifth lower water temperature signal; and deactivate the circulation pump in response to at least one selected from the group consisting of the second rate of the temperature increasing and the second difference decreasing.

8. The water heater of claim 1, wherein the predetermined high limit temperature threshold is determined based on the predetermined setpoint temperature threshold.

9. A method of operating a water heater, the water heater including a storage tank including a water inlet and a water outlet, a circulation pump configured to deliver water to an external heater of the water heater, an upper temperature sensor configured to sense an upper temperature related to an upper area of the tank and output an upper temperature signal corresponding to the upper temperature, and a lower temperature sensor configured to sense a lower temperature related to a lower area of the tank and output a lower temperature signal corresponding to the lower temperature, the method comprising:

receiving a first upper temperature signal and a first lower temperature signal;

comparing the first upper temperature signal to a sum of a setpoint temperature threshold minus a preset temperature differential value;

comparing the first lower temperature signal to a high limit temperature threshold; and activating the circulation pump in response to the first upper temperature signal being less than the sum of the setpoint temperature threshold minus the temperature differential value and the first lower temperature signal being less than the predetermined high limit temperature threshold.

10. The method of claim 9 further comprising:

while the circulation pump is activated, comparing a second lower temperature signal to the predetermined high limit temperature threshold; and in response to the second lower temperature signal being equal to or exceeding the predetermined high limit temperature threshold, deactivating the circulation pump.

11. The method of claim 10 further comprising in response to the second lower temperature signal exceeding the predetermined high limit temperature threshold, placing the water heater in a standby mode;

wherein, while in the standby mode, at least one selected from the group consisting of the predetermined setpoint temperature threshold and the predetermined high limit temperature threshold is updated.

12. The method of claim 11 wherein the predetermined setpoint temperature threshold is updated based on a maximum temperature sensed by the upper temperature sensor while the storage tank is in the standby mode.

13. The method of claim 11 further comprising while the circulation pump is activated, determining at least one selected from the group consisting of a rate of temperature based on a third lower water temperature signal and a difference between a second upper water temperature signal and the third lower water temperature signal; and deactivating the circulation pump in response to at least one selected from the group consisting of the rate of the temperature increasing and the difference decreasing.

14. The method of claim 13 further comprising:

activating the circulation pump in response to the first upper temperature signal being less than the sum of the predetermined setpoint temperature threshold minus the temperature differential value, the first lower temperature signal being greater than the predetermined high limit temperature threshold, a third upper temperature signal being less that the predetermined setpoint temperature threshold and a fourth lower temperature signal being less than a second predetermined high limit threshold; and in response at least one selected from the group consisting of the third upper temperature signal being greater than or equal to the predetermined setpoint temperature threshold and the fourth lower temperature signal being equal or greater than the second predetermined high limit temperature threshold, deactivating the circulation pump.

15. The method of claim 14 further comprising:

in response at least one selected from the group consisting of the third upper temperature signal being less than the predetermined setpoint temperature threshold and the fourth lower temperature signal being less than the second predetermined high limit temperature threshold, determining at least one selected from the group consisting of a second rate of temperature based on a fifth lower water temperature signal and a second difference between a fourth upper water temperature signal and the fifth lower water temperature signal; and deactivating the circulation pump in response to at least one selected from the group consisting of the second rate of the temperature increasing and the second difference decreasing.

16. The method of claim 9, wherein the predetermined high limit temperature threshold is determined based on the predetermined setpoint temperature threshold.

17. A water heater comprising:

a storage tank including a water inlet and a water outlet;

a circulation pump configured to deliver water to an external heater of the water heater;

a first temperature sensor configured to sense a first area temperature related to a first area of the tank and output a temperature signal corresponding to the first area;

a second temperature sensor configured to sense a second area temperature related to a second area of the tank and output a temperature signal corresponding to the second area;

an electronic processor configured to:

receive a first temperature signal corresponding to the first area and a first temperature signal corresponding to the second area;

compare the first temperature signal corresponding to the first area to a sum of a setpoint temperature threshold minus a preset temperature differential value;

compare the first temperature signal corresponding to the second area to a high limit temperature threshold; and activate the circulation pump in response to the first temperature signal corresponding to the first area being less than the sum of the setpoint temperature threshold minus the temperature differential value and the first temperature signal corresponding to the second area being less than the predetermined high limit temperature threshold.

18. The water heater of claim 17, wherein the electronic processor is further configured to:

while the circulation pump is activated, compare a second temperature signal corresponding to the second area to the predetermined high limit temperature threshold; and in response to the second temperature signal corresponding to the second area being equal to or exceeding the predetermined high limit temperature threshold, deactivate the circulation pump.

19. The water heater of claim 18, wherein the electronic processor is further configured to in response to the second temperature signal corresponding to the second area exceeding the predetermined high limit temperature threshold, place the water heater in a standby mode;

wherein, while in the standby mode, at least one selected from the group consisting of the predetermined setpoint temperature differential value and the predetermined high limit temperature threshold is updated.

20. The water heater of claim 19, wherein the electronic processor is further configured to:

while the circulation pump is activated, determine at least one selected from the group consisting of a rate of temperature based on a third lower water temperature signal and a difference between a second temperature signal corresponding to the first area and the third temperature signal corresponding to the second area; and deactivate the circulation pump in response to at least one selected from the group consisting of the rate of the temperature increasing and the difference decreasing.

* * * * *